US010188183B1

(12) United States Patent
Swerdlow

(10) Patent No.: US 10,188,183 B1
(45) Date of Patent: Jan. 29, 2019

(54) AMBULATORY AID

(71) Applicant: Linda Smith Swerdlow, Los Angeles, CA (US)

(72) Inventor: Linda Smith Swerdlow, Los Angeles, CA (US)

(73) Assignee: Aligned As Designed, LLC, Los Angeles, CA (US)

( * ) Notice: Subject to any disclaimer, the term of this patent is extended or adjusted under 35 U.S.C. 154(b) by 0 days.

(21) Appl. No.: 15/713,036

(22) Filed: Sep. 22, 2017

(51) Int. Cl.

| | |
|---|---|
| ***A45B 9/00*** | (2006.01) |
| ***A61H 3/00*** | (2006.01) |
| ***A45B 9/04*** | (2006.01) |
| ***A61H 3/02*** | (2006.01) |

(52) U.S. Cl.
CPC ..... *A45B 9/00* (2013.01); *A45B 9/04* (2013.01); *A61H 3/00* (2013.01); *A61H 3/0288* (2013.01); *A45B 2009/005* (2013.01)

(58) Field of Classification Search
CPC .... A45B 9/04; A45B 9/02; A45B 7/00; A45B 7/005; A61H 3/0288
See application file for complete search history.

(56) References Cited

U.S. PATENT DOCUMENTS

| | | | | |
|---|---|---|---|---|
| 2,417,171 A | | 3/1947 | McGowan | |
| 3,040,757 A | | 6/1962 | Smith | |
| 3,150,672 A | | 9/1964 | Johnson, Jr. | |
| 3,517,678 A | | 6/1970 | Gilsdorf | |
| 4,098,283 A | | 7/1978 | Tritle, Jr. | |
| 4,135,536 A | | 1/1979 | Willis | |
| 4,493,334 A | * | 1/1985 | Semanchik | A45B 9/00 135/75 |
| 4,572,227 A | | 2/1986 | Wheeler | |
| 5,103,850 A | | 4/1992 | Davis | |
| 5,139,040 A | * | 8/1992 | Kelly | A61H 3/02 135/69 |
| 5,163,710 A | | 11/1992 | Chirtel et al. | |
| 5,167,746 A | * | 12/1992 | Sheenan | A45B 9/04 135/77 |
| 5,353,825 A | | 10/1994 | Davis | |

(Continued)

FOREIGN PATENT DOCUMENTS

JP 2008272421 A * 11/2008

OTHER PUBLICATIONS

Search Report and Written Opinion dated Nov. 2, 2018 for PCT Application No. PCT/US18/52203, 13 pages.

*Primary Examiner* — David R Dunn
*Assistant Examiner* — Danielle Jackson
(74) *Attorney, Agent, or Firm* — Patterson Thuente Pedersen, P.A.

(57) ABSTRACT

An ambulatory aid, such as a walking cane, including an elongate shaft, a handle at a first, upper end of the shaft, and a foot piece at a second, lower end of the shaft opposite the first end. The cane shaft can be adjustable at a top end, middle, a bottom end, or any combination thereof. The top of the cane shaft is aligned at a more posterior angle then the bottom of the shaft. The handle of the cane is elongated and extends posterior and anterior to the shaft. In a particular embodiment, a posterior portion of the handle is longer, and optionally larger in surface area than an anterior portion of the handle such that the handle is configured so that when the person's hand is gripping the handle, the handle will be offset over the shaft.

29 Claims, 7 Drawing Sheets

(56) References Cited

U.S. PATENT DOCUMENTS 5,411,045 A 5/1995 Davis
5,417,234 A 5/1995 Davis
D442,123 S * 5/2001 Johnston ..... D12/133
6,374,841 B1 4/2002 Yamamoto et al.
6,527,001 B1 3/2003 Saldan et al.
6,851,438 B2 * 2/2005 Battiston ..... A61H 3/02 135/69
D511,889 S 11/2005 Cockrell
D570,094 S 6/2008 Wainwright
D587,894 S 3/2009 Wainwright
D632,476 S 2/2011 Owens et al.
8,778,031 B1 * 7/2014 Latour, Jr. ..... A61H 3/0288 135/65
9,358,176 B1 6/2016 Vaeth
9,681,714 B1 6/2017 Yeh
9,723,901 B1 8/2017 Ober et al.
9,918,893 B1 3/2018 Wanderman
9,974,367 B2 5/2018 Liu
2003/0106576 A1 6/2003 Tunnell, Jr. et al.
2006/0081279 A1 * 4/2006 Carlson ..... A45B 9/04 135/65
2007/0106397 A1 * 5/2007 Townsend ..... A61H 3/02 623/52
2008/0035190 A1 2/2008 Baker
2008/0035193 A1 2/2008 Baker
2008/0163914 A1 7/2008 Weber et al.
2008/0173340 A1 7/2008 Robbins
2009/0255562 A1 * 10/2009 Ruddy ..... A45B 9/04 135/77
2010/0229903 A1 * 9/2010 Ozuna ..... A45B 9/04 135/73
2013/0152986 A1 * 6/2013 Hunter ..... A61H 3/02 135/66
2013/0263901 A1 10/2013 Severson et al.
2014/0116484 A1 5/2014 Demski et al.
2014/0332045 A1 * 11/2014 Rudin ..... A45B 7/005 135/82
2016/0150859 A1 6/2016 Osman
2017/0181918 A1 6/2017 Weber et al.
2017/0208910 A1 * 7/2017 Liu ..... A45B 9/04

* cited by examiner

AMBULATORY AID

TECHNICAL FIELD

The present invention relates generally to ambulatory aids, and more specifically to walking canes.

BACKGROUND

The human body is a biological movement machine designed to maintain a centralized center of gravity inside its base of support (hereinafter "BOS"). Skeletal bones of the body form the framework, while skeletal muscles move the framework. Tendons found at the ends of skeletal muscles attach the skeletal muscles to the skeletal bones and help maintain the postural alignment of the body. Ligaments attach bone to bone, and have a limited amount of flexibility in order to maintain the attachment of the skeletal bones in the framework.

The articulating bones of the body that form joints stay aligned and positioned properly using skeletal muscles, ligaments, tendons, and fascia. Locomotion that keeps the joints aligned as designed and inside the body's natural BOS also keeps the skeletal muscles and fascia strong and flexible, and helps the body produce synovial fluid. Synovial fluid lubricates, shock absorbs and reduces friction on joints. It also brings nutrients to joints and removes carbon dioxide and metabolic waste.

When the joints of the human body are in postural alignment during locomotion, the body stays within its BOS and maintains a low center of gravity (hereinafter "COG"). The upward support force from the BOS aligns with the downward force of gravity. The stability of the body during locomotion depends on the gravitational balance and stability of the arms and legs. Injury or movement of a joint outside of the body's natural BOS creates overloading or under loading to all other joints due to the redistribution of forces. Under loading or over loading of a joint or movement that causes hyperextension of a joint or its supporting tissue can result in a loss of physical stability and postural alignment. Overtime, repetitive movement that doesn't maintain the body's COG over its base can result in physical and functional disability. The Specific Adaptation to Imposed Demands ("SAID") principle states that the body will gradually adapt to stresses and overloads that it is subjected to. Wolff's Law states that bone function changes cause bone structure modification. Davis's Law states that soft tissue's tendency is to shorten and contract unless subject to frequent stretching; in other words, and to quote Dr. Davis, "[u]se it or lose it." Hook's Law states that tissue strain is directly proportional to applied compressive or stretching stress so long as tissue elasticity is not exceeded.

The general principles of balance and stability include the following:

1. Gravity intersects the BOS of the subject;
2. Anything that decreases the BOS decreases stability of the subject;
3. The lower the COG above the BOS, the more stability of the subject;
4. Objects that have more mass over or near the COG tend to be more stable;
5. The farther the COG intersection line is from the edge of the BOS, the more stable the subject;
6. Stability is directly proportional to the area of the BOS on which a body rests;

7. Stability in a given direction is directly proportional to the horizontal distance of the COG from the edge of the BOS;
8. When two objects have a different shape, but an equal mass, the one with the wider base will be more stable;
9. The further the COG is from the direction of movement, the more likely it is to maintain stability;
10. When a body has balance and physical stability, it has equilibrium, and the COG is inside the BOS;
11. When the BOS is widened in the direction of the line of force (hereinafter "LOF"), the body has greater stability. When the BOS is widened laterally on one side of the body, the COG move closer to the edge and the body has less stability; and
12. Postural stability occurs when the COG and the LOF are over the center of pressure (COP).

Now, relating these principles to walking, during the normal gait cycle the arms as well as the rest of the body stay within the body's natural BOS to maintain the body's balance. The heel makes contact with the ground before the rest of the foot. The body's COG is over and inside its BOS. The shoulder and hip joints maintain vertical orientation and alignment with the pectoral and pelvic girdles. After the heel contacts the ground, the rest of the foot rolls onto an over the ground. The body's weight then passes over its COG as the heel lifts off the ground and the body moves forward. When the gait cycle has reciprocal movement, the shoulder, hip, knee and ankle joints work together to load the weight of the body over and on the foot within the body's BOS. The head stays positioned over the body and the line of sight is in the direction the person is moving.

During locomotion, the human foot has two functions. First, during the stance phase of the gait cycle the foot acts as a mobile adaptor and shock absorber to maintain the body's balance and physical stability on uneven surfaces or terrain. Second, during the swing phase of gait the foot lifts off the ground completely and acts as a lever to propel the body forward. A lever is a rigid bar resting on a pivot, used to help move a heavy or fixed load with one end when pressure is applied to the other.

Canes extend the BOS on one side of the body and act as a substitute for the hip flexors on that side by transmitting part of the body's weight to the ground. In order to have a mechanical advantage when using a traditional cane, the distance between the axis of the hip joint and the contralateral hand must be extended away from the body. The mean position of the COP shifts laterally toward the cane side to maintain the body's balance. However, when the COP moves laterally on one side only, the COG of the body moves higher and closer to the edge of the BOS. Due to the size, shape, and orientation of the traditional cane foot and its orientation with the cane shaft, the person's arm, wrist and head shift forward and downward during locomotion. When the head is positioned downward during locomotion, the line of sight is towards the ground. This causes a reduction to both sensory and proprioceptor input which results in a loss of afferent messages traveling from the body to the brain, as well as motor responses traveling from the brain back to the body. In order to maintain vertical orientation of the body during locomotion when the head and line of sight are positioned towards the ground, the length of the step as well as the stride must be shortened. As a result of the shortened strides, the heel of the foot nearest the cane stops striking the ground from heel to toe and the foot loses its ability to quickly transform from a mobile adaptor to a ridged lever during the gait cycle. Instead, the downward position of the head and line of sight along with the shortened step and stride force the heels to rotate medially towards each other, while the toes rotate laterally away from the direction the person is moving to maintain the body's vertical orientation.

Use of traditional canes can also cause continuous repetitive movement that hyperextends the wrist joint outside the body's natural BOS. The head of the humerus on the side of the body using the cane loses vertical alignment and postural equilibrium with the shoulder girdle during locomotion, as does the scapula. Overtime, movement that moves the COP laterally on one side of the body only, and hyperextends the wrist joint forward away from the body's natural BOS may result in physical and functional disability and pain. When the wrist joint hyperextends, the distance between the axis of the hip joint and the contralateral hand becomes greater. A body is in equilibrium when the downward directed linear force is equal to the upward force and the vector sum of all forces equals zero. When the COP on one side of the body is located laterally and at the edge of the BOS and not centrally orientated during locomotion, the body loses postural equilibrium and the COG becomes higher and less stable because low stability of a person or object is associated with a high COG and a gravity projection at the edge or outside of the BOS.

To put this in perspective, there are twenty-six bones, thirty-three joints, and over a hundred muscles, ligaments, and tendons in each foot. Thirty of the thirty-three joints found in each foot are synovial joints. Synovial joints have no blood supply of their own, and therefore rely on movement in and around the joint to maintain adequate levels of synovial fluid inside the joint. The size, shape, alignment, and positioning of the traditional cane foot with the cane shaft and handle keeps the body's weight from rolling over the foot nearest the cane from heel to toe. When the body weight does not roll over and onto the foot from heel to toe, the synovial joints of the foot stop producing adequate amounts of synovial fluid, and the muscles and fascia around the synovial joints of the feet contract and the feet can become painful.

There remains a need for an ambulatory aid or cane having a cane foot that more closely functions to mirror the normal gait cycle of the musculoskeletal system.

SUMMARY

In embodiments, an ambulatory aid, such as a walking cane, generally comprises an elongate shaft, a handle at a first, upper end of the shaft, and a foot piece at a second, lower end of the shaft opposite the first end. The shaft can comprise an elongate hollow, partially filled, or filled tube. The cane shaft can have a cross-section that is substantially circular, oval, square, rectangular, triangular, or any of a variety of suitable shapes. The shaft can be formed of lightweight aluminum, carbon fiber, plastic, or any of a variety of materials or combinations thereof, which are preferably light weight yet durable.

In embodiments, the cane shaft is adjustable at a top end, middle, a bottom end, or any combination thereof. In a particular embodiment, in which the cane shaft is adjustable at both the top and bottom ends of the shaft, this configuration allows the user to maintain postural stability and vertical alignment while adjusting the cane's height before sitting or standing, and before ascending or after descending a flight of stairs.

In embodiments, the top of the cane shaft is aligned at a more posterior angle then the bottom of the shaft. The handle of the cane is elongated and extends posterior and anterior to the shaft. In a particular embodiment, a posterior portion of the handle is longer, and optionally larger in surface area than an anterior portion of the handle such that the handle is configured so that when the person's hand is gripping the handle, the handle will be offset over the shaft.

In embodiments, the foot portion of the cane is elongated and extends anterior and posterior to the cane shaft. In a particular embodiment, an anterior portion of the foot portion is longer than the posterior portion. The bottom and sides of the foot portion are tubular or arcuate in shape. In other words, a surface contacting portion of the foot portion is non-planar, but is instead curved or arcuate, allowing the foot portion to roll onto and over a surface during the gait cycle, thereby mimicking the heel to toe motion of the normal gait cycle. In one embodiment, the cane foot is formed of an interior and a tubular rubber exterior, optionally with one or more ridges to provide friction and additional stability.

In a certain embodiment, an anterior portion of the foot portion and the posterior portion of the cane handle extend a substantially similar or the same length in relation to the center of the cane's shaft, while the posterior portion of the foot portion and the anterior portion of the cane handle also extend a substantially similar or the same length in relation to the center of the cane's shaft. With this configuration, a substantially vertical imaginary line extends from an end of the anterior portion is cane handle and the end of the posterior portion of the foot portion, creating two right triangles, one inverted to the other, the cane shaft forming the hypotenuse of each.

The canes according to the embodiments described herein give the user a mechanical advantage without extending the distance between the axis of the hip and the contralateral hand. The shaft of this cane is aligned at an angle with the handle and the foot, with the top of the cane shaft more posteriorly aligned than the bottom. This is done to reduce the distance between the axis of the hip joint and the contralateral hand and to help the foot nearest the cane strike the ground from heel to toe. As described above, when the foot strikes the ground from heel to toe it is able to act as a mobile adaptor during the stance phase of the gait cycle, and to act as a lever to help propel the body forward during the swing phase of the gait cycle.

Also, as discussed above, stability of a person or object is directly proportional to the alignment of the COG over the area of the BOS on which a body rests. During the swing phase of the gait cycle, the traditional cane shaft becomes more horizontal than vertical and only the small anterior edge of the cane's foot maintains the body's stability. The larger size, shape, and surface area of cane's foot or foot portion of the canes of the embodiments, as well as its orientation in relation to the cane's shaft and handle, keeps the cane's shaft more vertical to give the user more vertical stability during locomotion. As opposed to traditional canes, an entire front or anterior portion of the cane's foot, and not just the front edge, maintains contact with the ground during the swing phase of the gait cycle such that the body maintains a shorter distance between the hip joint's line of axis and the contralateral hand when standing and during locomotion when using this cane. Furthermore, the positioning of the cane's handle, relative to the foot portion and the shaft, keeps the wrist, arm, and shoulder joints from hyperextending in the direction of locomotion, and the orientation of the cane handle to the cane foot maintains the alignment of the bottom of the scapula with the shoulder girdle and the rest of the body during locomotion.

The head preferably maintains vertical orientation during locomotion in order to maintain postural alignment and stability with the rest of the body. In embodiments, the relationship between the cane's foot portion and handle keeps the LOG and the COP more centralized over the BOS during locomotion. Unlike traditional canes, the configuration of the canes according to the present embodiments allows the user to keep their head in postural alignment with the rest of their body and line of sight, and toes and heels moving in the direction that the subject is moving. This is preferred because when the line of sight is in the direction the person is moving, and not down at the ground, during locomotion the body experiences more sensory and proprioceptor input, and therefore balance and physical stability. In contrast to presently existing canes, embodiments of the present invention serve an unmet need because they better maintain the user's vertical orientation and postural stability during locomotion, when making transitions from sitting to standing, and when ascending or descending a flight of stairs.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
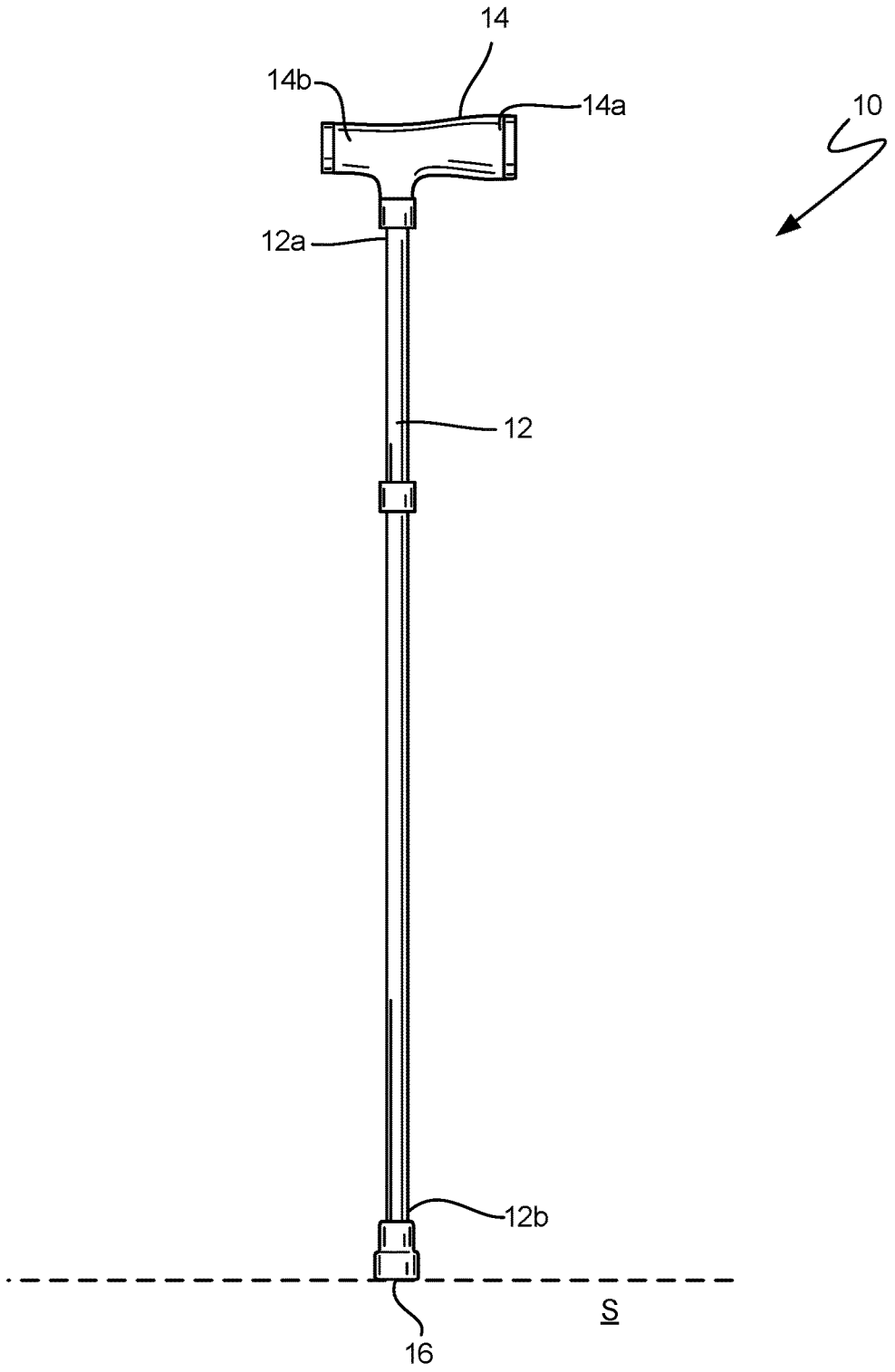
FIG. 1 is a perspective view of a traditional cane of the prior art.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION

Referring to FIG. 1, a traditional walking cane 10 of the prior art includes an elongate shaft 12 having a handle 14 coupled to a first end 12*a* of shaft 12, and a foot portion 16 coupled to a second end 12*b* of shaft 12. Handle 14 includes a posterior portion 14*a* extending rearward from shaft 12, and an anterior portion 14*b* extending forward from shaft 12. Typically, posterior portion 14*a* is longer than anterior portion 14*b* when measured from a center point of shaft 12 to accommodate a subject's hand gripping handle 14.

Foot portion 16 is typically circular in cross section, and extends radially from shaft 12 about a circumference of shaft 12 such that a surface contact portion 16*a* of foot portion 16 has a larger diameter than shaft 12. Shaft 12 extends substantially vertical from the handle 14 to the foot portion 16. As discussed above, this causes, during the swing phase of the gait cycle, the traditional cane shaft to become more horizontal than vertical and only the small anterior edge of the cane's foot maintains the body's stability. Furthermore, in order to have a mechanical advantage when using a traditional cane, the distance between the axis of the hip joint and the contralateral hand must be extended away from the body. The mean position of the COP shifts laterally toward the cane side to maintain the body's balance, which in turn, causes the COG of the body to move higher and closer to the edge of the BOS. Due to the size, shape, and orientation of the traditional cane foot and its orientation with the cane shaft, the person's arm, wrist and head shift forward and downward during locomotion, causing imbalance and instability in the short term, and pain in the longer term.

Figure 2:
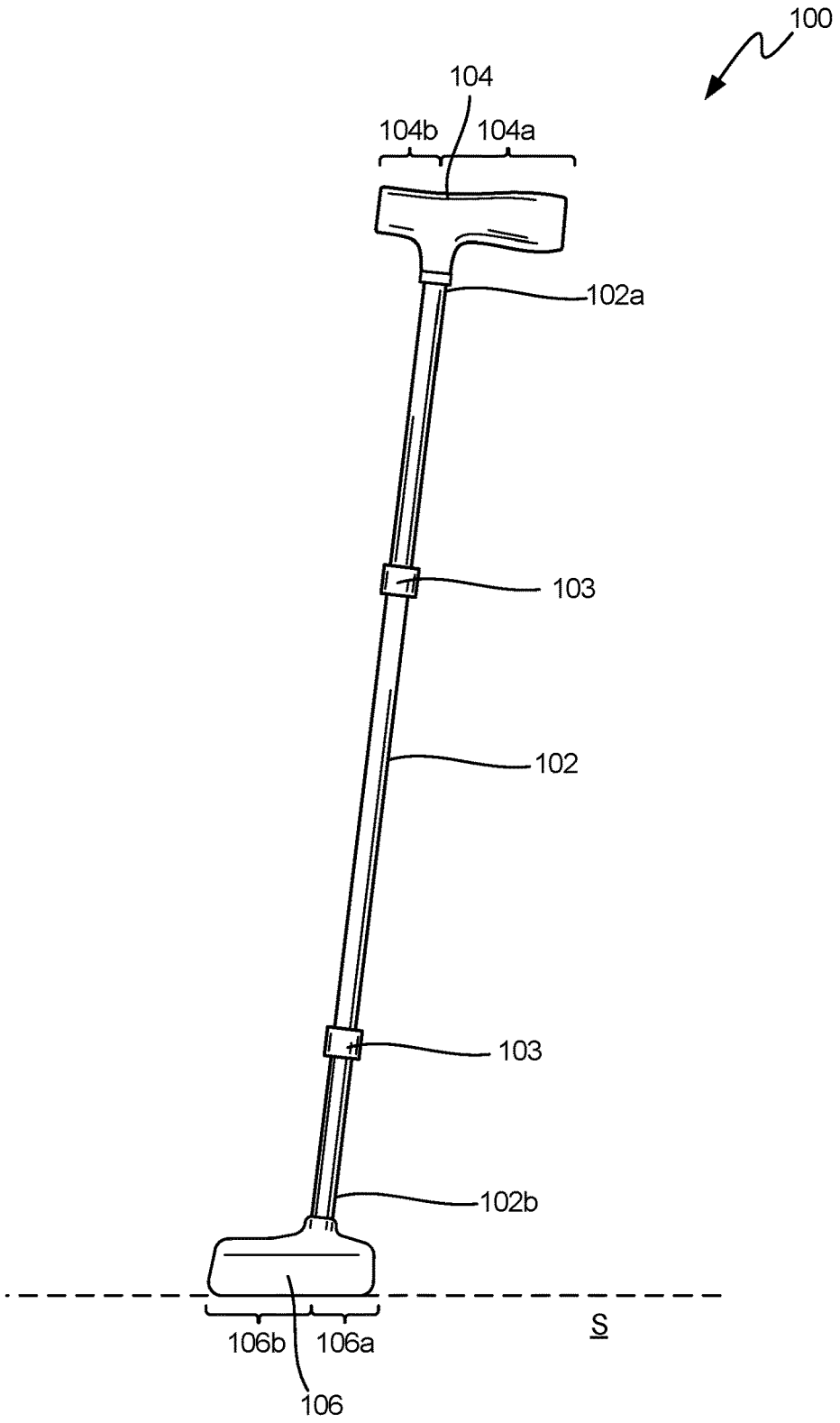
FIG. 2 is a perspective view of an ambulatory aid according to an embodiment.

Now referring to FIG. 2, according to an embodiment of the present invention, an ambulatory aid 100 generally comprises an elongate shaft 102 extending between a first end 102*a* and a second end 102*b*, a handle 104 coupled to first end 102*a*, and a foot piece 106 coupled to second end 102*b*. Shaft 102 can comprise an elongate hollow, partially filled, or filled tube. Shaft 102 can comprise a cross-section that is substantially circular, oval, square, rectangular, triangular, or any of a variety of suitable shapes. Shaft 102 can be formed of lightweight aluminum, carbon fiber, plastic, or any of a variety of materials or combinations thereof, which are preferably light weight yet durable.

In embodiments, shaft 102 can be height adjustable proximate first end 102*a*, at a middle portion, proximate second end 102*b*, or any combination thereof. Shaft 102 can be height adjustable be any suitable means known to one of ordinary skill in the art including, but not limited to, a threaded connector 103 which threadably engages two portions of shaft 102 by corresponding threads formed on the connector and portions. The two portions are in telescoping arrangement such that upon loosening of the connector, the first portion can either nest within or extend from second portion in order to shorten or lengthen, respectively, shaft 102. Upon suitable height, the connector is tightened by screwing. Other suitable adjustment mechanisms can including, for example, spring loaded pin(s) that are depressed, allowing the nested shaft portions to adjust relative to each other, and then released to allow the pin(s) to extend through an aperture of a series of apertures formed in shaft 102 at different heights.

In a particular embodiment, depicted in FIG. 2 in which cane shaft 102 is adjustable proximate both the top end and bottom end of shaft 102, this configuration allows the user to maintain postural stability and vertical alignment while adjusting the cane's height before sitting or standing, and before ascending or after descending a flight of stairs.

Figure 4:
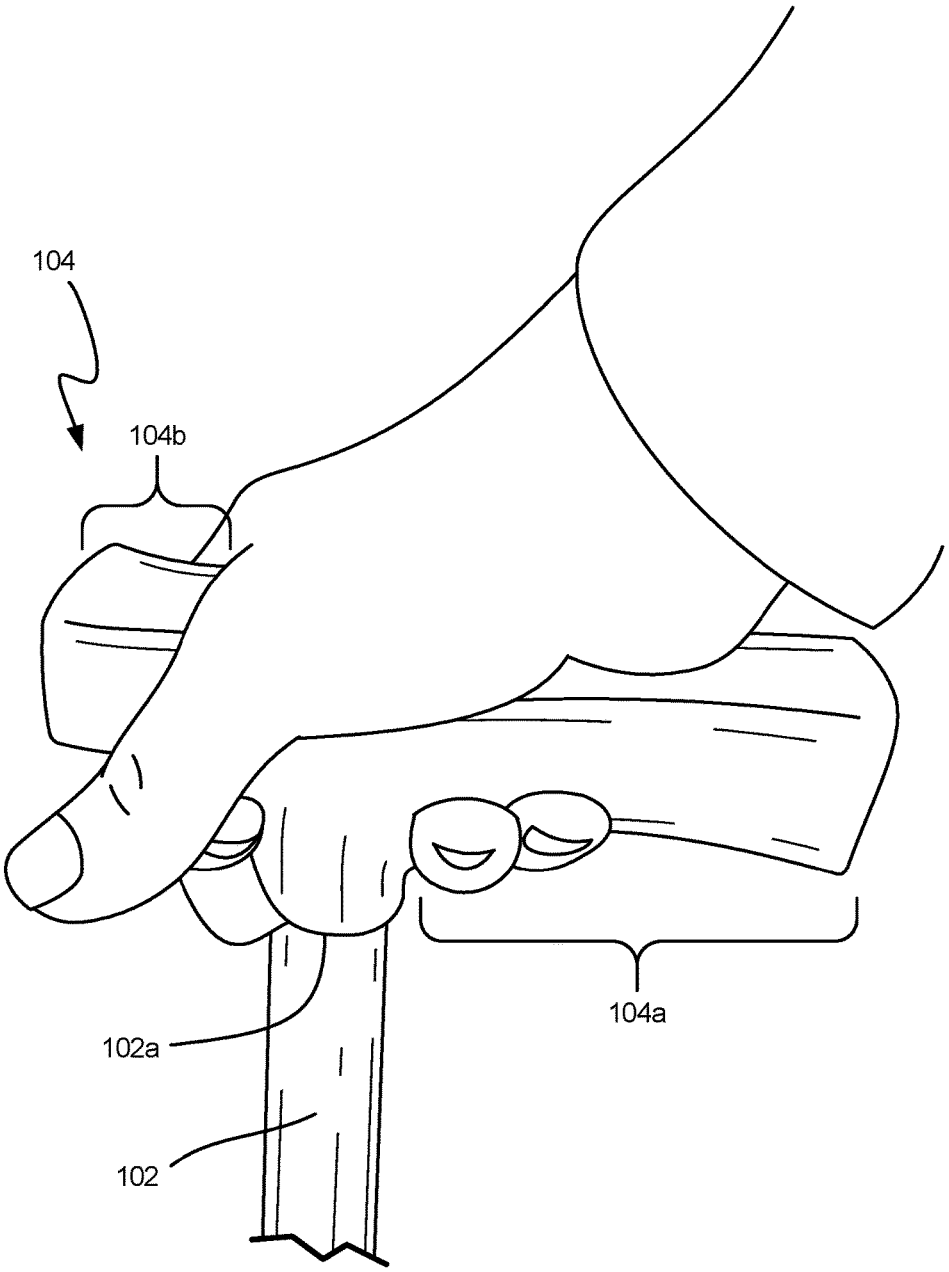
FIG. 4 is a close up view of a handle portion of an ambulatory aid according to an embodiment.

Referring back to FIG. 2, in embodiments, top end 102*a* of shaft 102 is aligned at a more posterior angle than bottom end 102*b* of shaft 102. Referring to FIG. 4, handle 104 of cane 100 is elongated and extends posterior and anterior to shaft 102. A total length of handle 104 can be from about 3 inches to about 7 inches, and more particularly about 5 inches. In a particular embodiment, a posterior portion 104*a* of handle 104 is longer, and optionally larger in surface area, than an anterior portion 104*b* of handle 104 when measured from a center point of shaft 102 such that handle 104 is configured so that when the person's hand is gripping the handle, handle 104 will be offset over shaft 102. Posterior portion 104*a* can be from about 1.25 to about 3 times longer than anterior portion 104*b*. In one particular embodiment, posterior portion 104*a* is 1.5 times longer than anterior portion 104*b*, and can be, for example, about 3 inches whereas anterior portion 104*b* can be about 2 inches, when measured from a center point of shaft 102.

Handle 104 can be shaped similar to a handle of a traditional cane, including a curved top surface, or can have a more linear top surface. Handle 104 can be of any suitable material, such as a open-cell or closed-cell foam, to provide suitable support yet comfort. Handle 104 can also include an optional cover to provide additional grip, such as a silicone or rubber cover. In embodiments, a circumference or perimeter of posterior portion 104*a* can be equal to or greater than anterior portion 104*b*. In one particular embodiment, a circumference of a forward most portion of anterior portion 104*b* can be from about 3 to about 5 inches, and more particularly about 4 inches, and widens to about 3.5 to about 5.5 inches, and more particularly about 4.5 inches to posterior portion 104*a*. In embodiments, widening from anterior portion 104*b* to posterior portion 104*a* can be continuous or discrete (step-change).

Figure 5:
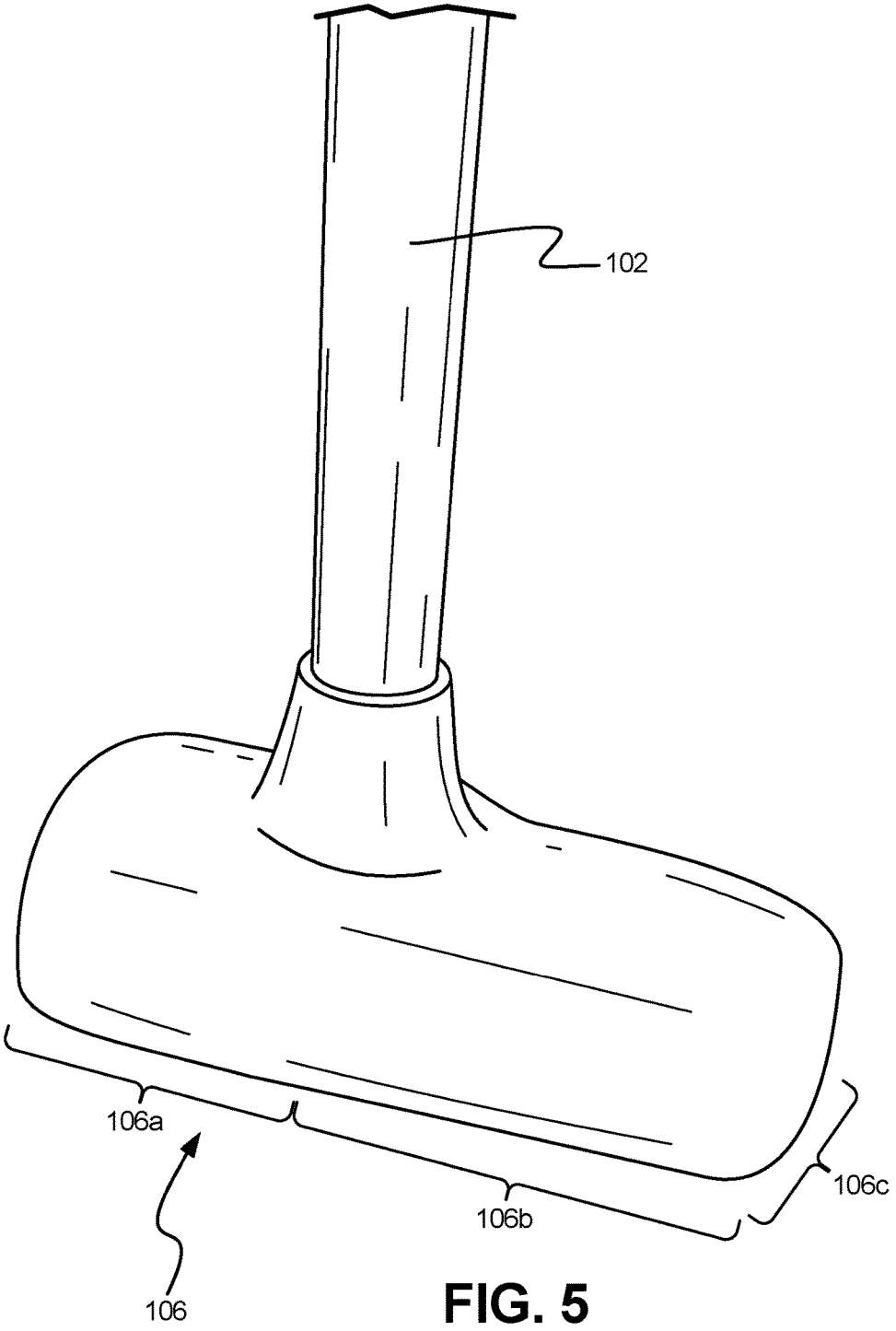
FIG. 5 is a close up view of a foot portion of an ambulatory aid according to an embodiment.

Now referring to FIG. 5, in embodiments, foot piece 106 of cane 100 is elongated and extends anterior and posterior to shaft 102. In a particular embodiment, an anterior portion 106*b* of foot piece 106 is longer than a posterior portion 106*a*. A total length of foot piece can be from about 3 inches to about 8 inches, and more particularly about 5-6 inches, and more particularly about 5.5 inches. In a particular embodiment, anterior portion 106*b* of foot piece 106 is longer, than posterior portion 106*b* of foot piece 106 when measured from a center point of shaft 102, thereby mimicking the heel and anterior portion of the foot relative to the tibia of the leg. Anterior portion 106*b* can be from about 1.25 to about 3.5 times longer than posterior portion 106*a*. In one particular embodiment, anterior portion 106*b* is 1.75 times longer than posterior portion 106*a*, and can be, for example, about 3.5 inches whereas posterior portion 106*a* can be about 2 inches, when measured from a center point of shaft 102.

A bottom surface 106*c* of foot piece 106 can be tubular or arcuate in shape. In other words, a surface contacting portion 106*c* of foot piece 106 is non-planar, and is curved or arcuate (circular or elliptical), allowing foot piece to roll onto and over a surface during the gait cycle, thereby mimicking the heel to toe motion of the normal gait cycle. In embodiments, a circumference or perimeter (non-circular) varies along the length of foot piece 106, such as from about 4 inches to about 7 inches, and optionally can be wider in areas proximate shaft 102, and then tapering in both the anterior and posterior directions. In other embodiments, a circumference or perimeter of foot piece 106 is substantially constant along anterior portion 106*b*, posterior portion 106*a*, or both. A height of foot piece 106 can be larger on an end of anterior portion 106*b* than an end of posterior portion 106*a*, and can range from about 1 inch to about 3 inches.

In one embodiment, foot piece 106 is formed of an interior material, such as an open-cell foam, closed-cell foam, plastic, or rubber material, and a tubular rubber or silicon exterior cover, optionally with one or more ridges formed thereon, to provide friction and additional stability.

Figure 3:
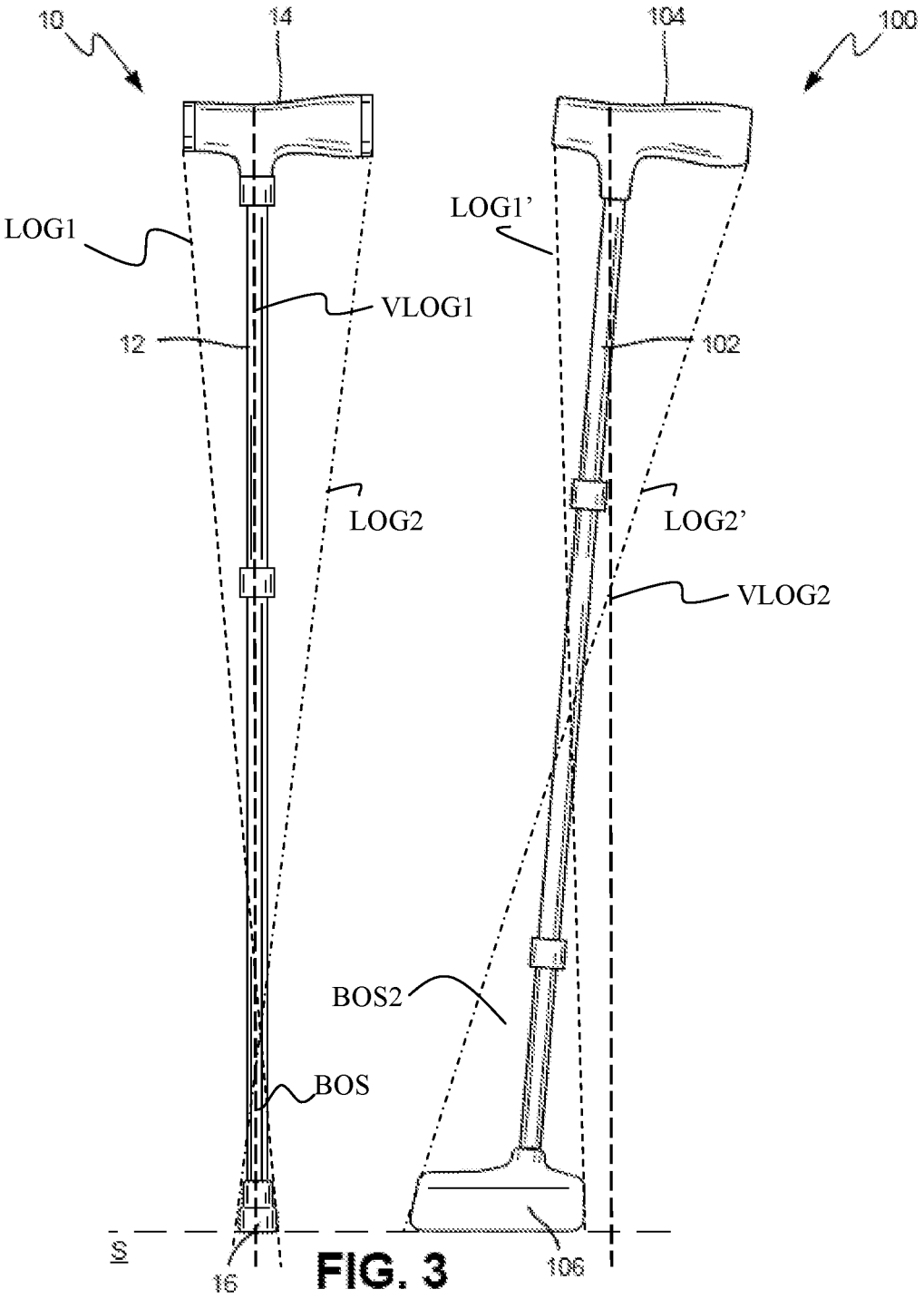
FIG. 3 is a side by side comparison of the prior art cane of FIG. 1 and the ambulatory aid of FIG. 2.

Now referring back to FIG. 3, a traditional cane 10 includes a vertical line of gravity VLOG1 extending from the center of cane shaft 12 to the surface S extends through a center of cane foot 16. A first line of gravity LOG1 extends from an end of the anterior portion of handle 14 to an end of the posterior portion of foot 16. A second line of gravity LOG2 extends from an end of posterior portion of handle 14 to an end of the anterior portion of foot 16. The intersection of VLOG1 and LOG2 is at a lower portion of shaft 12, and the area under the intersection point represents a low and narrow base of support BOS1.

Now referring to cane 100, a vertical line of gravity VLOG2 extends from the center of cane shaft 102 to the surface S is offset from a center of foot piece 106, and instead intersects surface S posterior to or at an end of posterior portion 106*a* of foot piece 106, depending on the length of the posterior portion 106*a* from the center of shaft 102. A first line of gravity LOG1' extends from an end of anterior portion 104*b* of handle 104 to an end of posterior portion 106*a* of foot piece 106. A second line of gravity LOG2' extends from an end of posterior portion 104*a* of handle 104 to an end of anterior portion 106*b* of foot 106. The intersection of VLOG2 and LOG2' is at a middle portion of shaft 12, and the area under the intersection point represents a much higher and larger base of support BOS2.

In some embodiments, LOG1' intersects or nearly intersects VLOG2 at surface S forming a very small angle such that LOG1' is almost vertical, whereas with cane 10, LOG1 intersects VLOG1 along shaft 12. The shape, alignment, and orientation of handle 104, foot piece 106, and shaft 102 of cane 100 keeps the wrist and shoulder in postural alignment and equilibrium with the midline of the body, and the shoulder and hip joints maintain vertical orientation and alignment with the pectoral and pelvic girdles.

Figure 6:
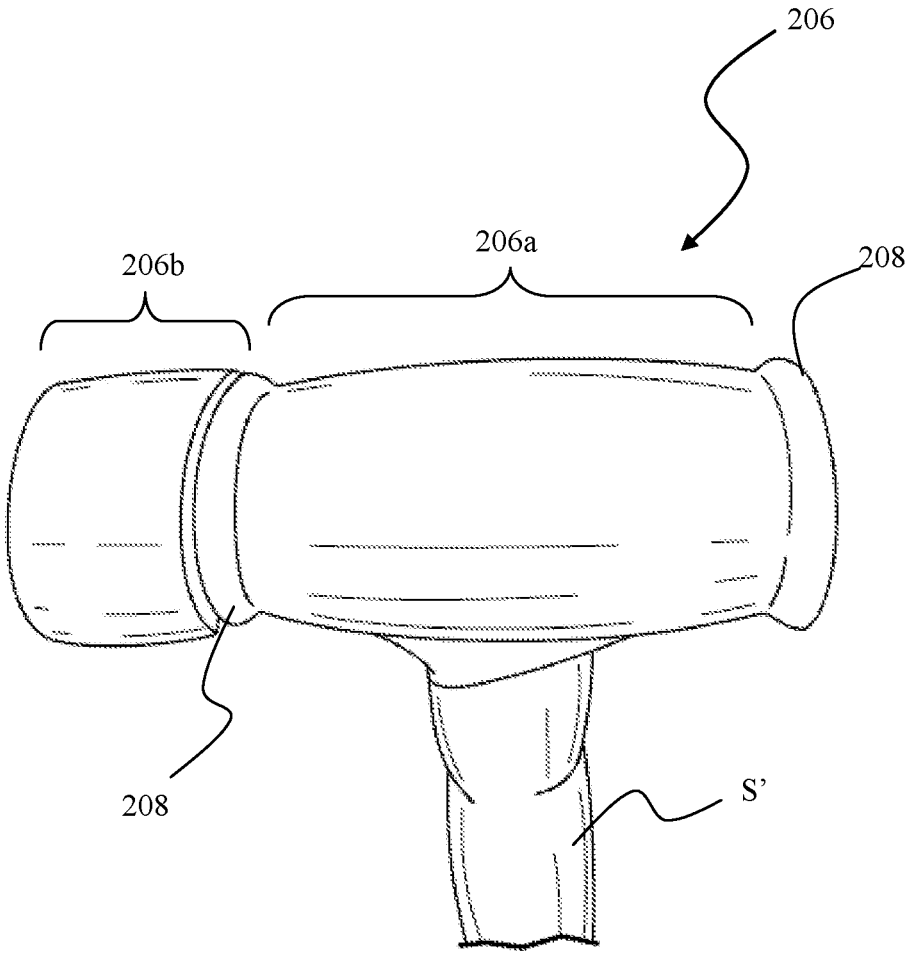
FIG. 6 is a perspective view of a foot portion of an ambulatory aid according to another embodiment.
Figure 7:
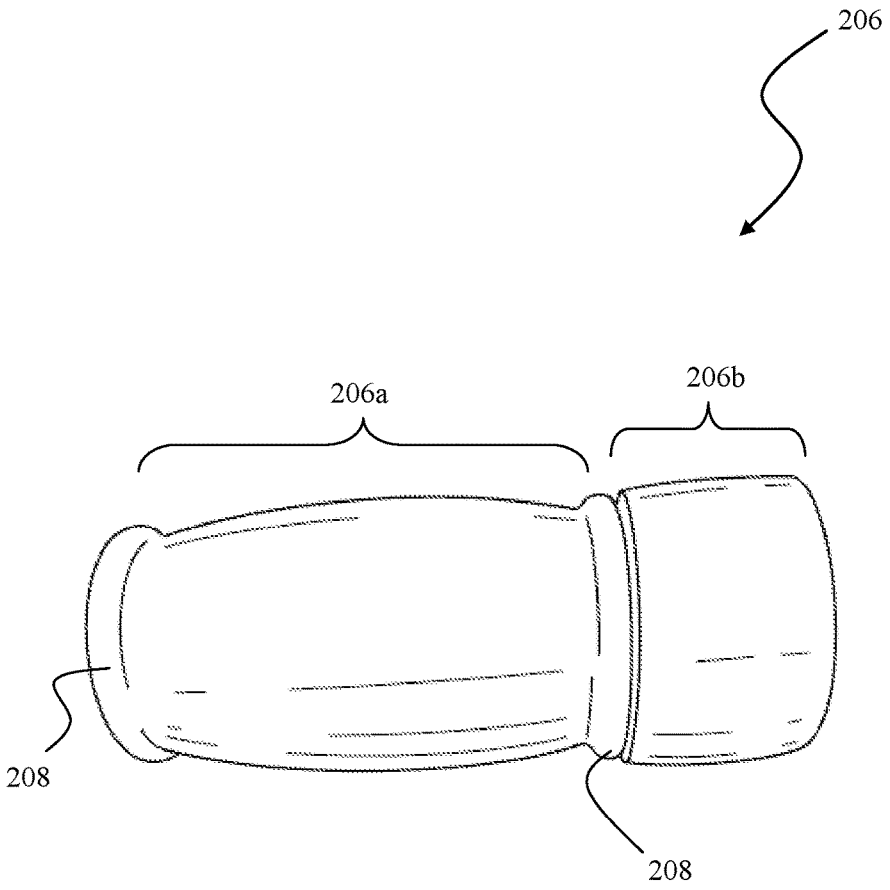
FIG. 7 is a bottom view of the foot portion of FIG. 6.

Now referring to FIGS. 6 and 7, foot piece 206 according to another embodiment includes a first portion 206*a* having a slightly varying diameter along its length, the largest diameter occurring at a central location, and which extends both anterior to and posterior to a shaft S of an aid, and a second portion 206*b*, which has a substantially constant diameter along its length, and extends anterior to first portion 206*a*. A radius of curvature of second portion 206*b* is significantly larger than an average radius of curvature of first portion 2061, such that second portion 206*b* appears "flatter" than first portion 206*a*. A ratio of the radius of curvature of second portion 206*b* to first portion 206*a* can be in a range from about 1.25:1 to about 5:1. First portion 206*a* can be separated from second portion 206*b* by one or more ridges 208, and/or can terminate in a ridge 208. Additional ridges can be formed along first portion 206*a* and/or second portion 206*b*, either transversely and/or longitudinally as desired.

As discussed above, the canes according to the embodiments described herein give the user mechanical advantage without extending the distance between the axis of the hip and the contralateral hand. The shaft of this cane is aligned at an angle with the handle and the foot, with the top of the cane shaft more posteriorly aligned than the bottom. This is done to reduce the distance between the axis of the hip joint and the contralateral hand and to help the foot nearest the cane strike the ground from heel to toe. As described above, when the foot strikes the ground from heel to toe it is able to act as a mobile adaptor during the stance phase of the gait cycle, and to act as a lever to help propel the body forward during the swing phase of the gait cycle.

As discussed above, stability of a person or object is directly proportional to the alignment of the COG over the area of the BOS on which a body rests. During the swing phase of the gait cycle, the traditional cane shaft becomes more horizontal than vertical and only the small anterior edge of the cane's foot maintains the body's stability. The larger size, shape, and surface area of cane's foot or foot portion of the canes of the embodiments, as well as its orientation in relation to the cane's shaft and handle, keeps the cane's shaft more vertical to give the user more vertical stability during locomotion. As opposed to traditional canes, an entire front or anterior portion of the cane's foot, and not just the front edge, maintains contact with the ground during the swing phase of the gait cycle such that the body maintains a shorter distance between the hip joint's line of axis and the contralateral hand when standing and during locomotion when using this cane. Furthermore, the positioning of the cane's handle, relative to the foot portion and the shaft, keeps the wrist, arm, and shoulder joints from hyperextending in the direction of locomotion, and the orientation of the cane handle to the cane foot maintains the alignment of the bottom of the scapula with the shoulder girdle and the rest of the body during locomotion.

The head preferably maintains vertical orientation during locomotion in order to maintain postural alignment and stability with the rest of the body. In embodiments, the relationship between the cane's foot portion and handle keeps the LOG and the COP more centralized over the BOS during locomotion. Unlike traditional canes, the configuration of the canes according to the present embodiments allows the user to keep their head in postural alignment with the rest of their body and line of sight, and toes and heels moving in the direction that the subject is moving. This is preferred because when the line of sight is in the direction the person is moving, and not down at the ground, during locomotion the body experiences more sensory and proprioceptor input, and therefore balance and physical stability. In contrast to presently existing canes, embodiments of the present invention serve an unmet need because they better maintain the user's vertical orientation and postural stability during locomotion, when making transitions from sitting to standing, and when ascending or descending a flight of stairs.

Although embodiments herein are representative of a walking cane, other ambulatory aids can be contemplated such as, for example, crutches, walking sticks, walking or arm braces, or any of a variety of ambulatory aids.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. An ambulatory aid comprising:

an elongate, straight shaft;

a handle coupled to a first end of the shaft at a fixed angle; and a foot piece coupled to a second end of the shaft at a fixed angle, wherein the first end of the shaft is coupled to the handle such that a posterior portion of the handle extends from the shaft at a length greater than an anterior portion of the handle, and the second end of the shaft is coupled to the foot piece such that an anterior portion of the foot piece extends from the shaft at a length greater than a posterior portion of the foot portion, and wherein the shaft extends at an angle between the handle and the foot piece when measured from a horizontal surface.

2. The ambulatory aid of claim 1, wherein a length of the posterior portion of the handle is from about 1.25 to about 3 times a length of the anterior portion when measured from a center of the shaft.

3. The ambulatory aid of claim 2, wherein a length of the posterior portion of the handle is about 1.5 times a length of the anterior portion of the handle when measured from the center of the shaft.

4. The ambulatory aid of claim 1, wherein a length of the anterior portion of the foot piece is from about 1.25 to about 3.5 times a length of the posterior portion of the foot piece when measured from a center of the shaft.

5. The ambulatory aid of claim 4, wherein a length of the anterior portion of the foot piece is about 1.75 times a length of the posterior portion of the foot piece when measured from the center of the shaft.

6. The ambulatory aid of claim 1, wherein the foot piece comprises a non-planar surface contacting portion configured to roll over a surface.

7. The ambulatory aid of claim 6, wherein a transverse cross-section of the foot piece is semi-circular or semi-elliptical in shape.

8. The ambulatory aid of claim 6, wherein the foot piece comprises a grip covering having one or more ridges defined on the surface contacting portion and extending transverse to a length of the foot piece.

9. The ambulatory aid of claim 1, wherein the foot piece has a non-continuous height along a length of the foot piece.

10. The ambulatory aid of claim 9, wherein a height of an end of the anterior portion of the foot piece distal a center of the shaft is greater than a height of an end of the posterior portion of the foot piece distal the center of the shaft.

11. An ambulatory aid comprising:

an elongate shaft;

a handle coupled to a first end of the shaft at a fixed angle such that a posterior portion of the handle extends from the shaft at a length greater than an anterior portion of the handle; and a foot piece coupled to a second end of the shaft at a fixed angle, wherein an anterior portion of the foot piece extends from the shaft at a length greater than a posterior portion of the foot piece, and wherein an imaginary vertical line extending from a center of the shaft at the first end does not intersect and is behind the posterior portion of the foot portion.

12. The ambulatory aid of claim 11, wherein a length of the anterior portion of the foot piece is from about 1.25 to about 3.5 times a length of the posterior portion of the foot piece when measured from the center of the shaft.

13. The ambulatory aid of claim 12, wherein a length of the anterior portion of the foot piece is about 1.75 times a length of the posterior portion of the foot piece when measured from the center of the shaft.

14. The ambulatory aid of claim 11, wherein a length of the posterior portion of the handle is from about 1.25 to about 3 times a length of the anterior portion when measured from the center of the shaft.

15. The ambulatory aid of claim 14, wherein a length of the posterior portion of the handle is about 1.5 times a length of the anterior portion of the handle when measured from the center of the shaft.

16. The ambulatory aid of claim 11, wherein the foot piece comprises a non-planar surface contacting portion configured to roll over a surface.

17. The ambulatory aid of claim 16, wherein a transverse cross-section of the foot piece is semi-circular or semi-elliptical in shape.

18. The ambulatory aid of claim 11, wherein the foot piece comprises a grip covering having one or more ridges defined on the surface contacting portion and extending transverse to a length of the foot piece.

19. The ambulatory aid of claim 1, wherein the elongate shaft is adjustable in at least two positions on the shaft.

20. The ambulatory aid of claim 19, wherein the elongate shaft is adjustable at a first position proximate the first end of the shaft, and wherein the elongate shaft is adjustable at a second position of the shaft.

21. The ambulatory aid of claim 20, wherein a first portion of the shaft extending from the first end of the shaft to the first position and a second portion of the shaft extending from the second end of the shaft to the second position are both configured to telescope within and/or over a middle portion extending between the first and second positions.

22. The ambulatory aid of claim 20, wherein a first portion of the shaft extending from the first end of the shaft to the first position is configured to nest within a middle portion of the shaft extending between the first and second positions, and a second portion of the shaft extending from the second end of the shaft to the second position is configured to nest within the middle portion.

23. The ambulatory aid of claim 1, wherein the foot piece comprises:

a first elongate portion having a first length, and a circular cross-section; and a second elongate portion adjacent the first elongate portion, the second elongate portion having a second length less than the first length, and a substantially circular cross-section, wherein an average radius of curvature of the first elongate portion is less than an average radius of curvature of the second elongate portion.

24. The ambulatory aid of claim 23, wherein a diameter of the first elongate portion varies along the first length.

25. The ambulatory aid of claim 24, wherein a maximum diameter of the first elongate portion is at a center point along the first length.

26. The ambulatory aid of claim 23, wherein a diameter of the second elongate portion is substantially constant along the second length.

27. The ambulatory aid of claim 23, wherein a first end of the first elongate portion adjacent the second elongate portion comprises structure defining a ridge.

28. The ambulatory aid of claim 27, wherein a second end opposite the first end of the first elongate portion comprises structure defining a ridge.

29. The ambulatory aid of claim 23, wherein a ratio of the radius of curvature of the second elongate portion to the radius of curvature of the first elongate portion is in a range of from about 1.25:1 to about 5:1.

* * * * *